United States Patent [19]

Rose

[11] Patent Number: 4,781,529

[45] Date of Patent: Nov. 1, 1988

[54] HYDRAULIC PUMPING SYSTEM

[76] Inventor: Loren J. Rose, 300 N. Highland, Memphis, Tenn.

[21] Appl. No.: 308,794

[22] Filed: Oct. 5, 1981

[51] Int. Cl.[4] ..... F01D 25/00

[52] U.S. Cl. ..... 415/168; 417/199.2

[58] Field of Search ..... 417/199 A; 415/1, 11, 415/53 R, 144, 168

[56] References Cited

U.S. PATENT DOCUMENTS

| | | | |
|---|---|---|---|
| 1,080,917 | 12/1913 | Lewis | 415/53 |
| 1,314,875 | 9/1919 | La Bour | 415/53 |
| 1,560,754 | 11/1925 | Broido | 417/199 A |
| 1,789,528 | 1/1931 | Lewis | 415/53 |
| 1,830,923 | 11/1931 | Bradford | 417/199 A |
| 1,997,418 | 4/1935 | Hornschuch et al. | 417/199 A |
| 3,940,058 | 2/1976 | Norris | 415/1 X |

FOREIGN PATENT DOCUMENTS

| | | | |
|---|---|---|---|
| 530791 | 3/1921 | France | 415/53 |
| 71962 | 4/1947 | Norway | 415/53 |

*Primary Examiner*—Harvey C. Hornsby
*Assistant Examiner*—Frankie L. Stinson
*Attorney, Agent, or Firm*—Walker & McKenzie

[57] ABSTRACT

A hydraulic pumping system for use with a pump to pump liquid from a first location to a second location. The system includes first and second chambers, a gas passageway for allowing gas to exit the first and second chambers, and a liquid passageway for selectively allowing liquid to pass from the second chamber to the first chamber.

6 Claims, 6 Drawing Sheets

HYDRAULIC PUMPING SYSTEM

BACKGROUND OF THE INVENTION

1. Field of the Invention

The present invention relates to a hydraulic pumping system for use in combination with any standard hydraulic pump.

2. Description of the Prior Art

Hydraulic pumps are manufactured by a number of companies throughout the world in an almost unlimited number of design configurations. Such pumps may be of the screw, centrifugal, or valveless type, etc. for use in pumping liquid from an origin source to a final fluid destination. Pumps and pump systems have been developed that are self-priming. See, for example, Seabore, U.S. Pat. No. 1,558,640 and Carter, U.S. Pat. No. 1,824,465. None of the above patents, taken as a whole, disclose or suggest the present invention.

While such self-priming pumps have solved many problems associated with pumping liquids and mixtures of liquids and solids, should part of the pumped suction liquid column become vapor during a pumping cycle, such pumps will not perform their work as predicted by their performance curve and/or the pumps can be damaged.

SUMMARY OF THE INVENTION

The present invention is directed toward overcoming many of the problems associated with the pumping of liquids. The concept of the present invention is to combine any standard hydraulic pump with a system that will ensure the transfer of liquid from the origin source to prime the selected pump and through the discharge portion of the system to the final fluid destination while handling solids up to the maximum size according to the capacity of the pump. All the various components of the system are activated by movement of the fluid within the system. The system will purge gas from within the system at a higher than atmosphere pressure.

The hydraulic pumping system of the present invention comprises, in general, a first chamber or deck for communicating with the inlet port of a pump means and with a first location (i.e., the origin source of the liquid to be pumped); a second chamber or deck for communicating with the outlet port of the hydraulic pump means and with a second location (i.e., the final destination of the liquid to be pumped) through a liquid outlet means; a gas outlet means; a gas passageway means for allowing gas to exit the first and second chambers through the gas outlet means; and a liquid passageway means for selectively allowing liquid to pass from the second chamber to the first chamber.

DESCRIPTION OF THE PREFERRED EMBODIMENT

Figure 1:
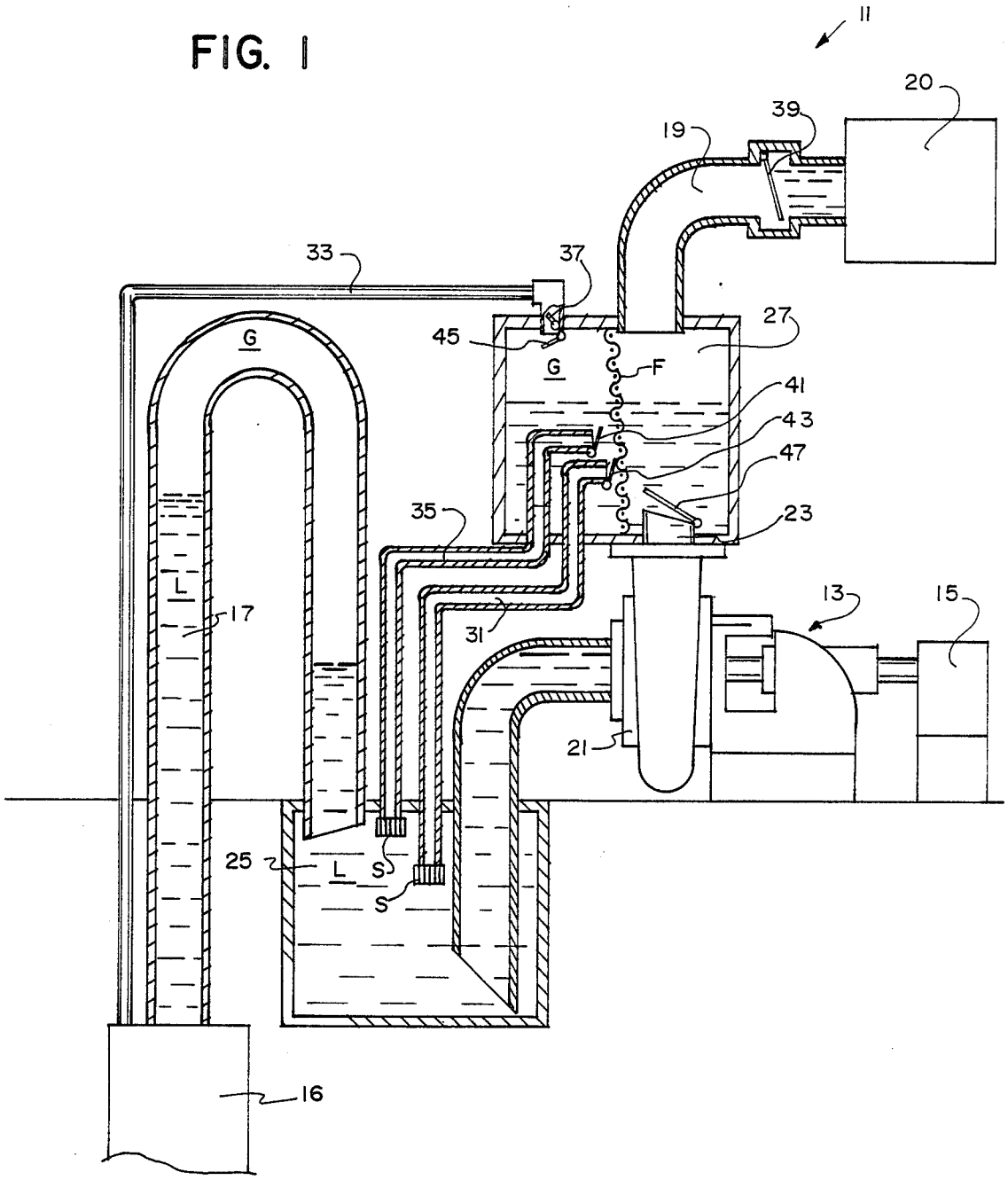
FIG. 1 is a somewhat diagrammatic sectional view of a first embodiment of the hydraulic pumping system of the present invention.
Figure 2:
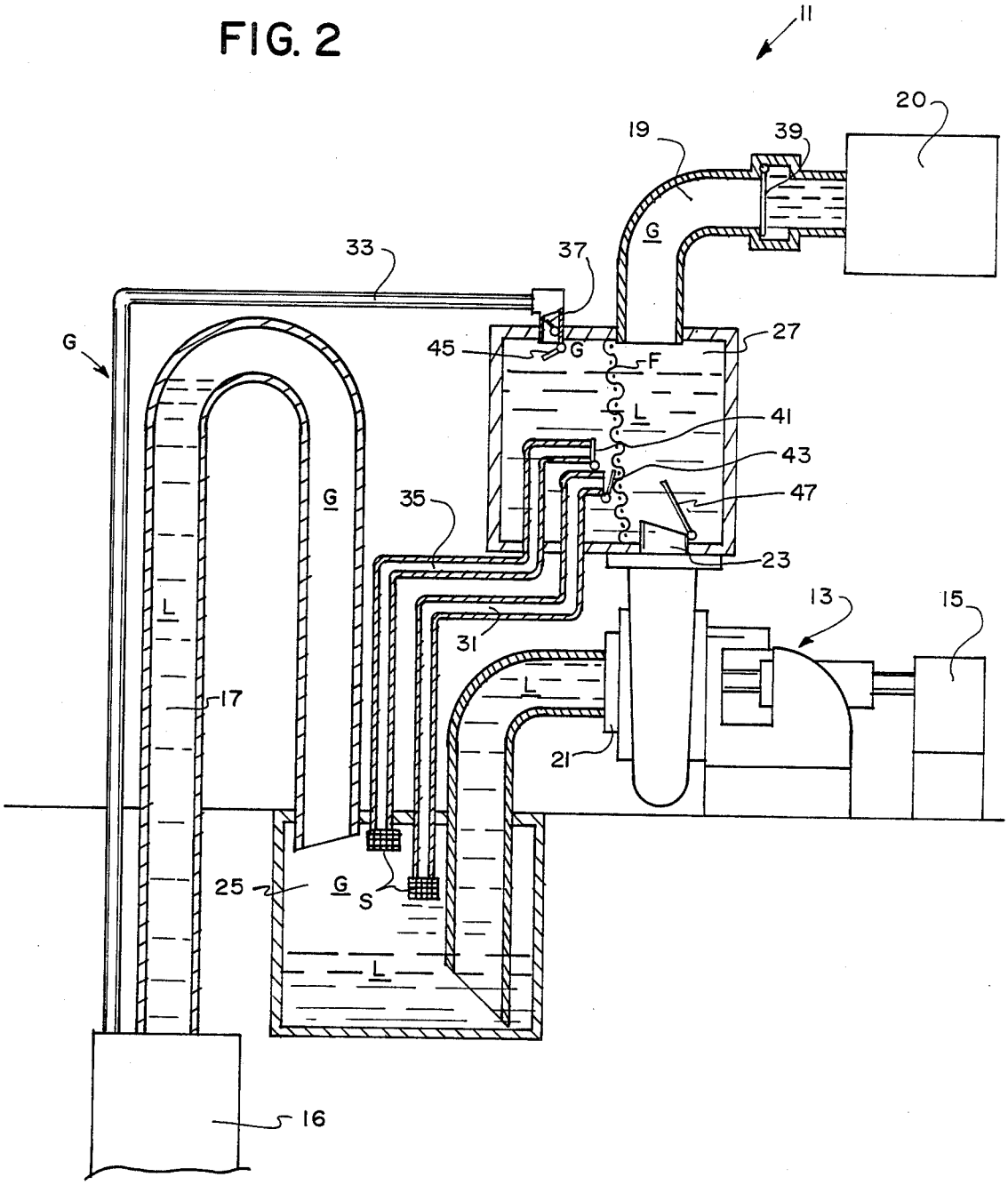
FIG. 2 is similar to FIG. 1 but with certain elements in a moved position.
Figure 3:
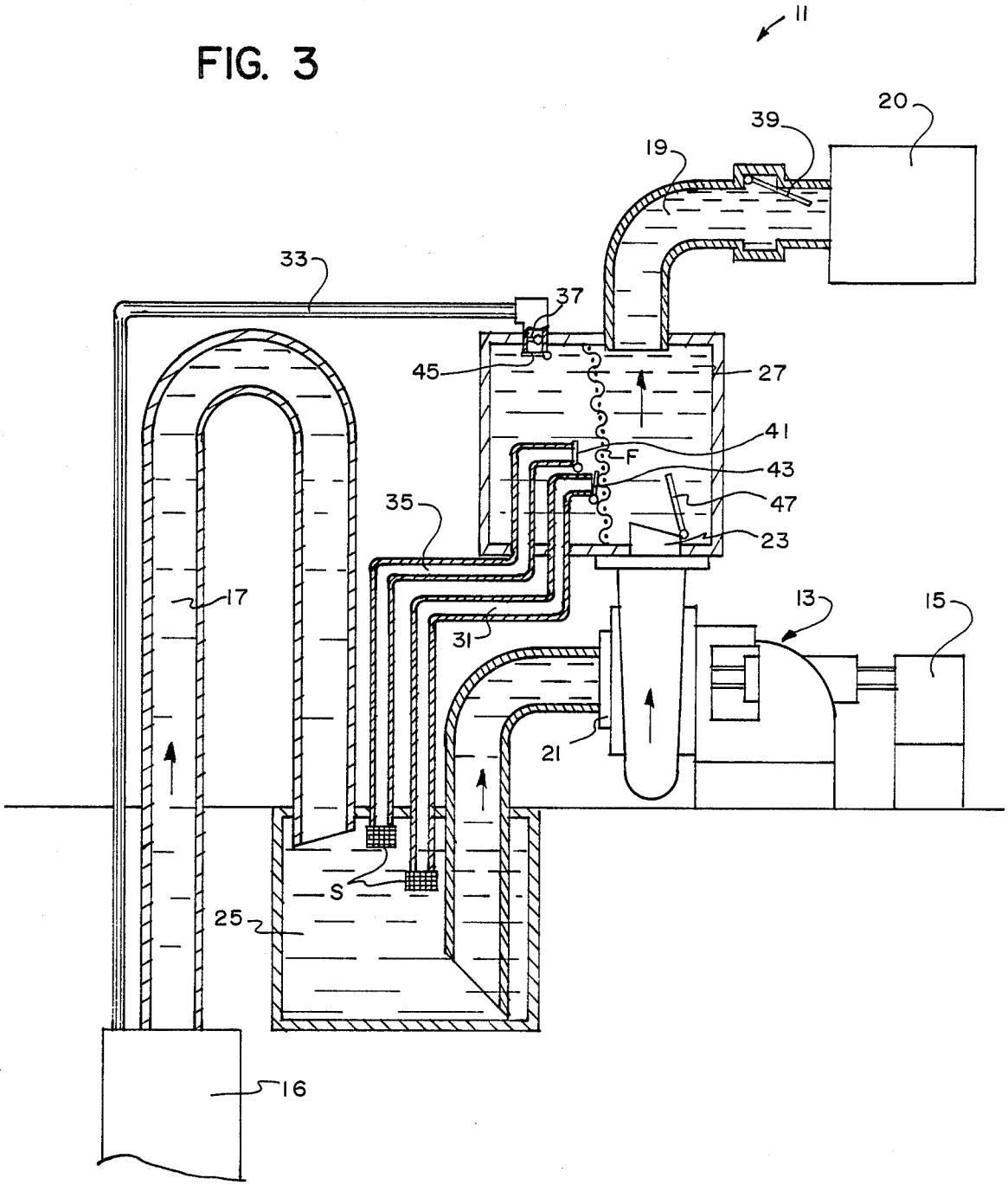
FIG. 3 is similar to FIGS. 1 and 2 but with certain elements in a moved position.

A first embodiment of the hydraulic pumping system of the present invention is somewhat diagrammatically shown in FIGS. 1–3 and identified by the numeral 11. The hydraulic pumping system 11 is for use in combination with any standard hydraulic pump, such as, for example, a centrifugal pump means 13 powered by a suitable gas or electric motor 15 whereby liquid can be pumped from a first location (an origin source) such as an underground well 15 through a liquid inlet means such as a suction pipe 17 and a liquid outlet means such as a discharge pipe 19 to a second location (a point of final liquid destination) such as a storage tank 20. The pump means 13 has an inlet port 21 for normally receiving liquid from the suction pipe 17 and has an outlet port 23 for normally directing liquid to the discharge pipe 19.

The hydraulic pumping system 11 includes, in general, a substantially closed first chamber or deck 25 for communicating with the inlet port 21 of the pump means 13 and with the suction pipe 17; a substantially closed second chamber or deck 27 for communicating with the outlet port 23 of the pump 13 and with the discharge pipe 19; a gas passage way means for communicating with a gas outlet means and for allowing gas to exit the first and second chambers 25, 27; and a liquid passageway means 31 for selectively allowing liquid to pass from the second chamber 27 to the first chamber 25.

The gas outlet means may include a pipe member 33 extending from the second chamber 27 to the atmosphere or to a higher than atmosphere pressure tank or the like (not shown) for storing the gas or back to the well 16 for allowing gas to pass from the second chamber 27 to the atmosphere, the tank, or the well 16. The gas outlet means may also include a pipe member 35 extending between the first and second chambers 25, 27 for allowing gas to pass from the first chamber 25 to the second chamber 27.

The hydraulic pumping system 11 preferably includes a first valve means 37 for preventing gas from passing from the gas outlet means (e.g., the pipe member 33) into the second chamber 27. The hydraulic pumping system 11 preferably includes a second valve means 39 for preventing liquid from passing from the liquid outlet means (e.g, the discharge pipe 19) into the second chamber 27. The hydraulic pumping system 11 preferably includes a third valve means 41 for preventing liquid or gas from passing from the second chamber 27 through the gas passageway means (e.g., the pipe member 35) into the first chamber 27 while allowing gas to pass from the first chamber 25 through the gas passageway means (e.g., the pipe member 35) into the second chamber 27. The hydraulic pumping system 11 preferably includes a fourth valve means 43 for preventing liquid from passing from the second chamber 27 through the liquid passageway means 31 while the pump means 13 is pumping liquid. The hydraulic pumping system 11 preferably includes a fifth valve means 45 for preventing liquid from passing from the second chamber 27 through the gas passageway means (e.g., the pipe member 33) while the pump means 13 is pumping liquid. The hydraulic pumping system 11 preferably includes a sixth valve means 47 for preventing liquid from passing from the second chamber 27 into the pump means 13 while the pump means 13 is stopped. The various valve means 37–47 may be of any construction and operation now apparent to those skilled in the art.

Filter media F may be provided in the second chamber 27 to divide the second chamber 27 into two parts and to prevent solids being pumped through the outlet port 23 of the pump means 13 from plugging the gas outlet means and/or liquid passageway means. Screens S may be provided over the ends of the gas outlet means and liquid passageway means.

The operation of the hydraulic pumping system 11 is quite simple. Upon initial start-up procedure, such as after service, the pump means 13 and first chamber 25 will be substantially sealed with a liquid as indicated by the letter L in FIG. 1. At least a portion of the suction pipe 17 will be "dry" but will contain a gas as directed by the letter G in FIG. 1. The motor 15 is started to cause the pump means 13 to pump liquid L from the first chamber 25 into the second chamber 27 as diagrammatically illustrated in FIGS. 1 and 2. The first and fifth valve means 37, 45 will remain open in this stage to allow gas G to be forced from the second chamber 27 as the liquid L is pumped from the first chamber 25 into the second chamber 27. The second, third and fourth valve means 39, 41, 43 will be closed. After substantially all of the liquid L has been pumped from the first chamber 25 into the second chamber 27, the pump means 13 will lose its suction and the fourth valve means 43 will open, allowing liquid to pass through the liquid passageway means 31 from the second chamber 27 back into the first chamber 25. The first valve means 37 will close, thus substantially sealing the second chamber 27 whereby the gas G remaining in the second chamber after the liquid L has passed back into the first chamber to be at a negative pressure. As the liquid L passes from the second chamber 27 back into the first chamber 25 through the liquid passageway means 31, it will displace at least a portion of the gas G remaining in the first chamber 25 and the suction pipe 17. This displaced gas G will, aided by negative pressure in the second chamber 27, pass through the pipe member 35 into the second chamber 27. The process will be then repeated a sufficient number of times, with the atmospheric pressure of the gas G remaining in the system being reduced each time, until a stable pump prime is established as indicated in FIG. 3. When a stable pump prime is established, the second and sixth valve means 39, 47 will be opened and the first, third, fourth and fifth valve means 37, 41, 43, 45 will be closed. If a stable pump prime is lost anytime while the pump means 13 is activated, the above process will automatically start until a stable pump prime is maintained.

Figure 4:
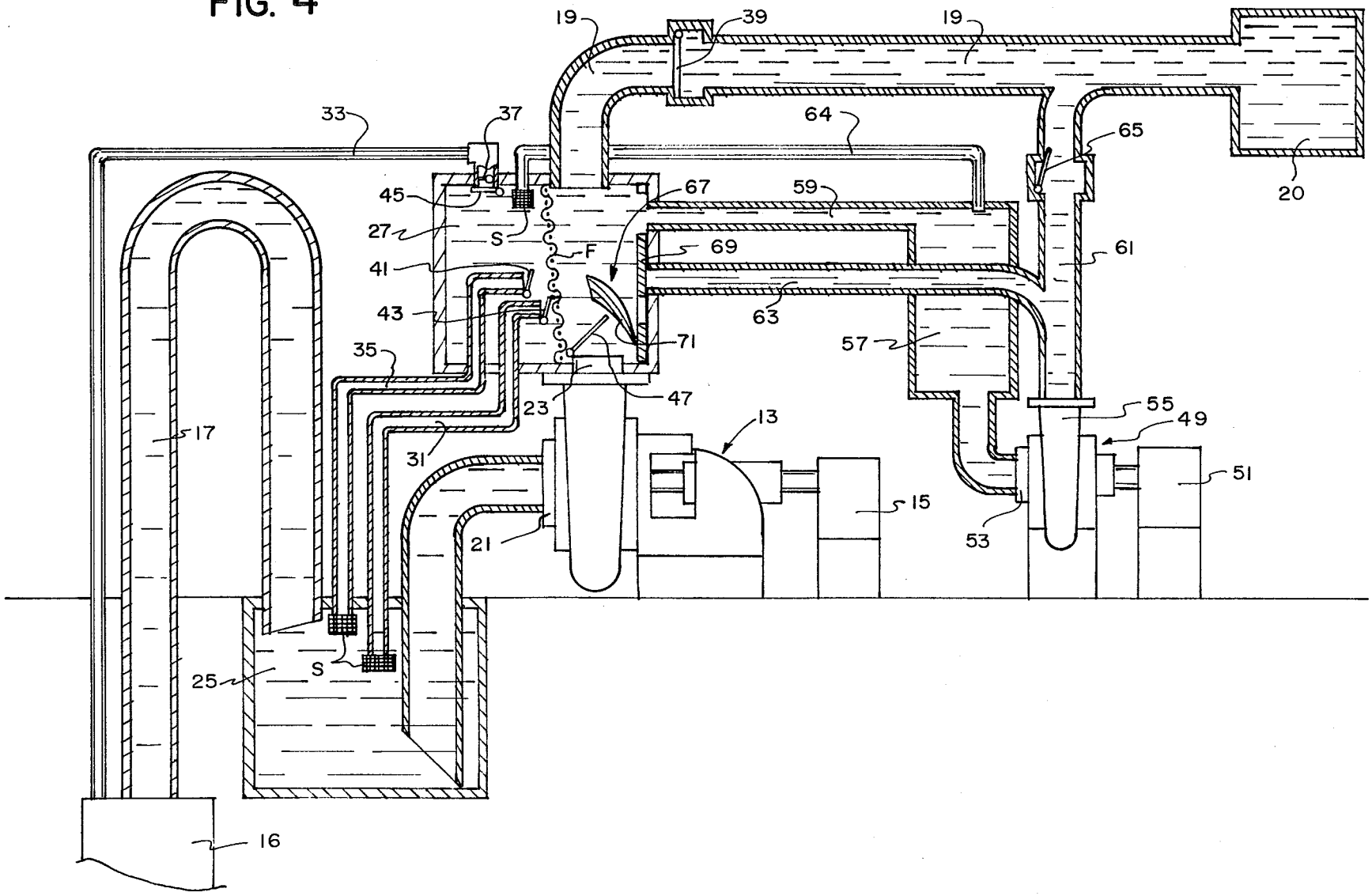
FIG. 4 is similar to FIG. 1 but shows a modified version thereof.

A modified version of the hydraulic pumping system 11 is shown in FIG. 4 in which the pump means 13 is a low pressure pump and in which a high pressure pump means 49 powered by a suitable gas or electric motor 51 (it should be noted that the pump means 13 and the pump means 49 may be driven by the same motor connected to the pump means 13, 49 by appropriate connections, not shown, well known to those skilled in the art). The pump means 49 has an inlet port 53 and an outlet port 55. A substantially closed third chamber 57 is coupled to the inlet port 53 of the pump means 49. A pipe member 59 extends between the second chamber 27 and the third chamber 57 to selectively allow liquid to pass from the second chamber 27 to the third chamber 57. A pipe member 61 extends from the outlet port 55 of the pump means 49 to the discharge pipe 19 to selectively allow liquid to be pumped from the third chamber 57 to the discharge pipe 19 by the pump means 49. A pipe member 63 extends between the pipe member 61 and the second chamber 27 for selectively allowing liquid to pass between the pipe member 61 and the second chamber 27. A pipe member 64 may extend between the second chamber 27 and the third chamber 57 to allow gas to pass from the third chamber 57 to the second chamber 27. A screen S may be placed over the outlet end of the pipe member 64. A seventh valve means 65 is located between the pipe member 61 and the discharge pipe 19 for preventing fluids or the like from passing from the discharge pipe 19 through the pipe member 61 when the pump means 49 is deactivated or the like. A special eighth valve means 67 is positioned in the second chamber 27 for selectively blocking the pipe member 59 or the pipe member 63. The eighth valve means 67 includes a slide plate member 69 and a trap means 71 attached to the slide plate member 69 for causing the slide plate member 69 to move from a first position as shown in FIG. 4 in which the pipe member 59 is open to allow liquid to pass from the second chamber 27 to the third chamber 57 and in which the pipe member 61 and the second chamber 27. The trap means 71 is constructed in a manner that when the pump means 13 is pumping substantially solid-free liquid, the slide plate member 69 will remain in the first position but that when the pump means 13 pumps liquid with a substantial amount of solids, the slide plate member 69 will be moved to a second position in which the pipe member 59 is blocked thus preventing fluid from flowing from the second chamber 27 to the third chamber 57 in which the pipe member 63 is opened thereby allowing fluid to pass from the pipe member 61 to the second chamber 27. Such an arrangement allows liquid being pumped at a high pressure from the pump means 49 to aid the liquid being pumped at a lower pressure from the pump means 13 to cause solid material to pass through the discharge pipe 19.

A second embodiment of the hydraulic pumping system of the present invention is diagrammatically shown in FIGS. 5–8 and identified by the numeral 2.11. The hydraulic pumping system 2.11 is for use in combination with any standard hydraulic pump, such as, for example, a centrifugal pump means 2.13 powered by a suitable gas or electric motor 2.15 to pump liquid from a first location (an origin source), such as an underground source 2.16 of the liquid, through a liquid inlet means such as a suction pipe 2.17 and a liquid outlet means such as a discharge pipe 2.19, to a second location (a point of final liquid destination), such as a storage tank 2.20. The pump means 2.13 has an inlet port 2.21 for normally receiving liquid from the suction pipe 2.17 and has an outlet port 2.23 for normally directing liquid to the discharge pipe 2.19.

Figure 7:
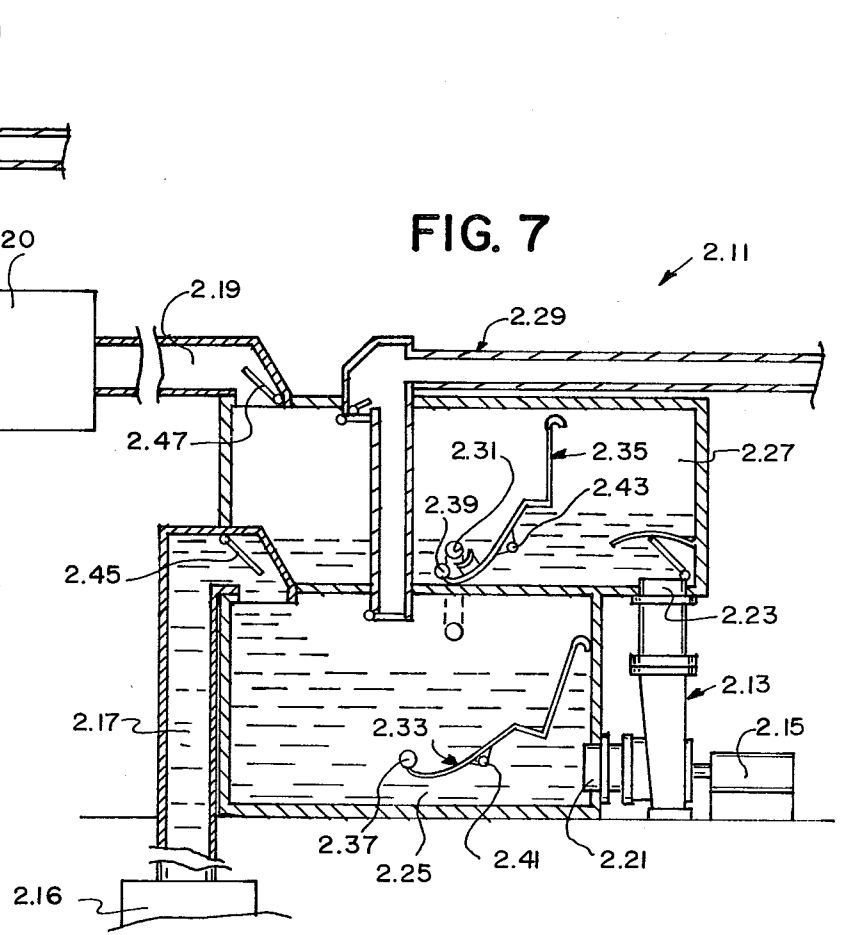
FIG. 7 is similar to FIG. 5 but with certain elements in a moved position.
Figure 5:
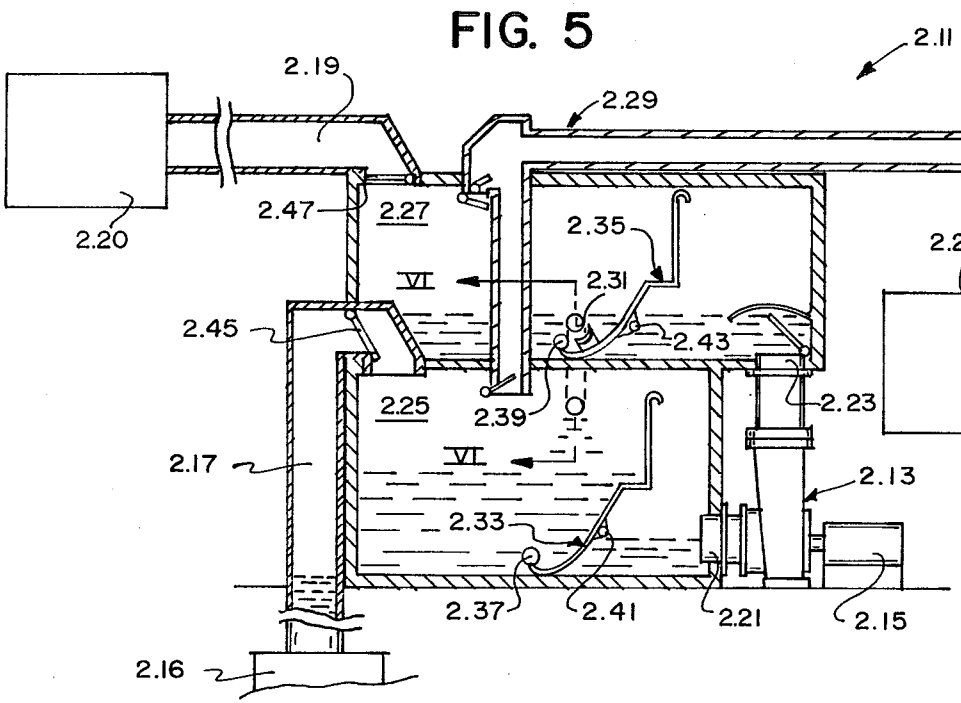
FIG. 5 is a somewhat diagrammatic sectional view of a second embodiment of the hydraulic pumping system of the present invention.
Figure 6:
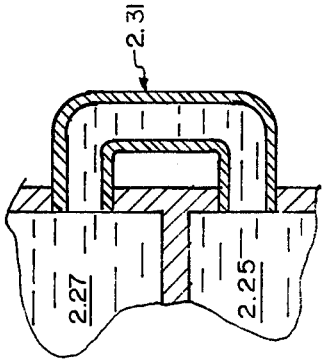
FIG. 6 is a sectional view as taken on line VI—VI of FIG. 5.
Figure 8:
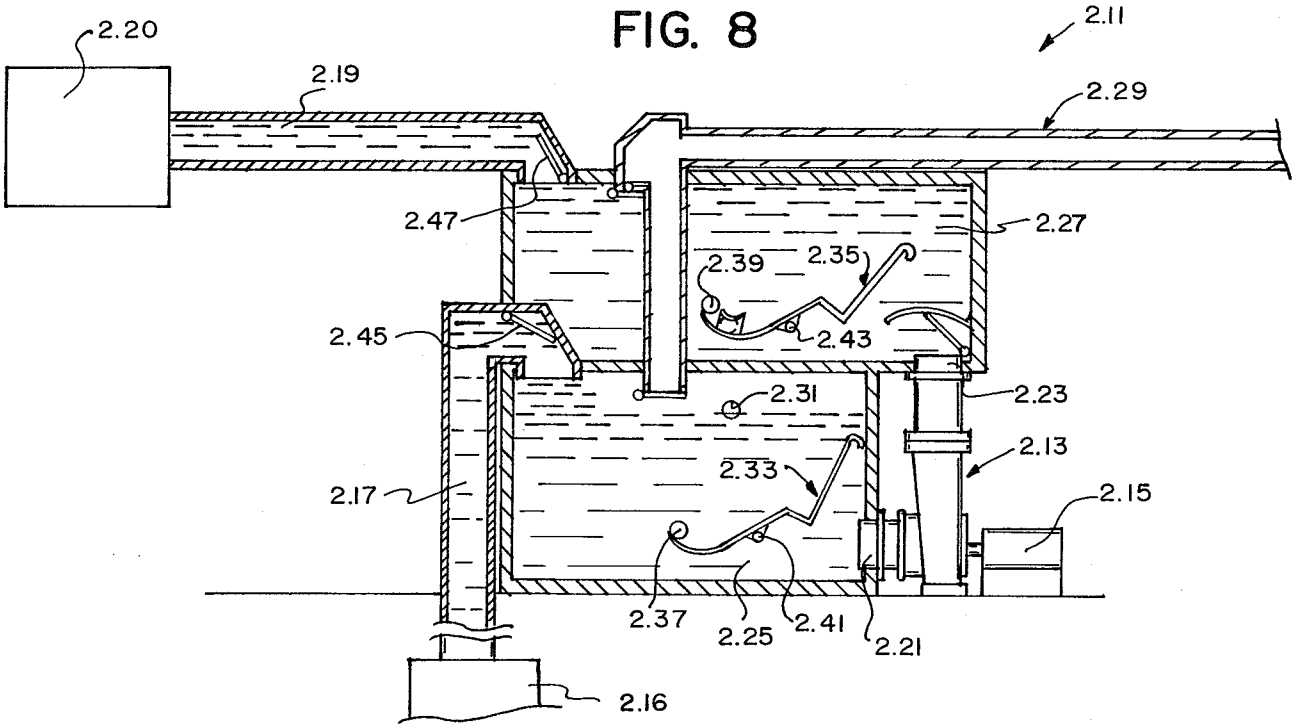
FIG. 8 is similar to FIGS. 5 and 7 but with certain elements in a moved position.

The hydraulic pumping system 2.11 includes, in general, a substantially closed first chamber or deck 2.25 for communicating with the inlet port 2.21 of the pump means 2.13 and with the suction 2.17; a substantially closed second chamber or deck 2.27 for communicating with the outet port 2.23 of the pump 2.13 and with the discharge pipe 2.19; a gas outlet means 2.28; a gas passageway means 2.29 for allowing gas to exit the first and second chambers 2.25, 2.27 through the gas outlet means 2.28; and a liquid passageway means 2.31 for selectively allowing liquid to pass from the second chamber 2.27 to the first chamber 2.25. The hydraulic pumping system 2.11 preferably includes a first gate means 2.33 for providing a substantially liquid-tight gate in the first chamber 2.25 between the inlet port 2.21 of the pump 2.13 and the suction pipe 2.17, and for movement between a first position as shown in FIG. 5 in which liquid flow through the first chamber 2.25 between the suction pipe 2.27 and the inlet port 2.21 of the pump means 2.13 is blocked and a second position as shown in FIGS. 7 and 8 in which liquid flow through the first chamber 2.25 between the suction pipe 2.17 and the inlet port 2.21 of the pump means 2.13 is not blocked. The hydraulic pumping system 2.11 also preferably includes a second gate means 2.35 for providing a substantially liquid-tight gate in the second chamber 2.27 between the outlet port 2.23 of the pump means 2.13 and the discharge pipe 2.19 and for movement between a first position as shown in FIGS. 5 and 7 in which liquid flow through the second chamber 2.27 between the outlet port 2.23 of the pump means 2.13 and the discharge pipe 2.19 is blocked and a second position as shown in FIG. 8 in which liquid flow through the second chamber 2.27 between the outlet port 2.23 of the pump means 2.13 and the discharge pipe 2.19 is not blocked. The liquid passageway means 2.31 of the hydraulic pumping system 2.11 allows liquid to pass from the second chamber 2.27 to the first chamber 2.25 when the second gate means 2.35 is in the first position as shown in FIGS. 5 and 7 and is closed when the second gate means 2.35 is in the second position as shown in FIG. 8.

A first ballast means 2.37 is preferably included for normally urging the first gate means 2.33 to the first position. A second ballast means 2.39 is preferably provided for normally urging the second gate means 2.35 to the first position. First gate means 2.33 is preferably pivotally attached to the first chamber 2.25 by way of a pivot means 2.41. The second gate means 2.35 is preferably pivotally attached to the second chamber 2.27 by way of a pivot means 2.43.

The operation of the hydraulic pump means 2.11 is quite simple. Upon initial start-up procedure, such as after service, the pump 2.13 and first and second chambers 2.25, 2.27 will be filled with the liquid. The suction pipe 2.17 will be "dry" from the liquid source level but will contain a gas at a low pressure. The pump 2.13 is started to pump the liquid from the first chamber 2.25 through the second chamber 2.27 to the discharge pipe 2.19. After the major portion of the liquid has been removed from the first chamber 2.25, the pump 2.13 will lose hydraulic suction at its inlet port 2.21 and the first chamber 2.25 and the suction pipe 2.17 will be at a reduced absolute pressure corresponding to the voided volume of the first chamber 2.25 as compared to the volume less liquid in the suction pipe 2.17. When the pump 2.13 loses its hydraulic suction, the second gate means 2.35 will pivot to the first position shown in FIG. 5 allowing liquid to pass through the liquid passageway means 2.31 from the second chamber 2.27 to the first chamber 2.25. A check valve 2.45 between the first chamber 2.25 and the suction pipe 2.17 will close as will a check valve 2.47 between the second chamber 2.27 and the discharge pipe 2.19. As the liquid drains from the second chamber 2.27 into the first chamber 2.25 through the liquid passageway means 2.31, gas vapor will be expelled from the first chamber 2.25 through the gas passageway means 2.29 and the second chamber 2.27 will have a reduced atmospheric pressure. The first gate means 2.33 will prevent the fluid passing from the second chamber 2.27 to the first chamber 2.25 from passing to the inlet port 2.21 of the pump 2.13 until a sufficient amount of fluid has entered the first chamber 2.25 to trip the first gate means 2.33 (depending on the weight of the first ballast means 2.37 and the location of the pivot means 2.43). When sufficient liquid has entered the first chamber 2.25, the first gate means 2.33 will pivot to the second position as shown in FIG. 7 allowing the liquid in the first chamber 2.25 to be pumped into the second chamber 2.27. As the pump 2.13 then pumps fluid from the first chamber 2.25 into the second chamber 2.27, the second gate means 2.35 will pivot from the closed position shown in FIGS. 5 and 7 to the opened position shown in FIG. 8. This will cause still lower absolute pressure (or higher vacuum) reading in the suction pipe 2.17. This cycle will be repeated until stable pump prime is established. Once stable pump prime has thus been established the first and second gate means 2.33, 2.35 will remain in the opened position shown in FIG. 8 and the pump means 2.13 will pump fluid from the suction pipe 2.17 to the discharge pipe 2.19. In the event of suction failure, the first and second gate means 2.33, 2.35 will move to the closed position and the above cycle repeated until a stable pump prime is again established.

Although the present invention has been described and illustrated with respect to preferred embodiments thereof, it is not to be so limited since changes and modifications can be made therein which are within the full intended scope of the invention. Thus, for example, the system of the present invention can be adapted for use with demersible pumps or the like in manners which will now be apparent to those skilled in the art.

I claim:

1. Hydraulic pump system for use with a pump means having an inlet port and an outlet port for pumping liquid from a first location to a second location through a liquid outlet means, said system comprising:

(a) a first chamber positioned below said pump means for communicating with said inlet port of said pump means and with said first location;

(b) a second chamber for communicating with said outlet port of said pump means and with said second location, said outlet port being located at the bottom of said second chamber;

(c) gas outlet means;

(d) gas passageway means for allowing gas to exit said first and second chambers through said gas outlet means, said gas passageway means extending between said first chamber and said gas outlet means bypassing said pump means for allowing gas to exit said first chamber without passing through said pump means;

(e) liquid passageway means for selectively allowing liquid to pass from said second chamber to said first chamber;

(f) gas passageway valve means for preventing liquid or gas from passing from said second chamber through said gas passageway means into said first chamber while allowing gas to pass from said first chamber through said gas passageway means into said second chamber;

(g) liquid passageway valve means for preventing liquid from passing from said second chamber through said liquid passageway means while said pump means is pumping liquid;

(h) pump valve means attached to said outlet port of said pump means within said second chamber and at the bottom of said second chamber for preventing liquid from passing from said chamber into said pump means when said pump means is not pumping liquid; and (i) said gas passageway valve means, said liquid passageway valve means and said pump valve means being operatively coupled to one another for causing said gas passageway valve means and said liquid passageway valve means to close when said pump valve means opens and for causing said gas passageway valve means and said liquid passageway valve means to open when said pump valve means closes.

2. The hydraulic pumping system of claim 1 in which is included a first valve means for preventing gas from passing from said gas outlet means into said second chamber; and in which is included a second valve means for preventing liquid from passing from said liquid outlet means into said second chamber.

3. The hydraulic pumping system of claim 2 in which is included a valve means for preventing liquid from passing from said second chamber through said gas passageway means while said pump means is pumping liquid.

4. The hydraulic pumping system of claim 1 in which is included a first gate means for providing a substantially liquid tight gate in said first chamber between said inlet port of said pump means and said first location and for movement between a first position in which liquid flow through said first chamber between said first location and said inlet port of said pump means is blocked and a second position in which liquid flow through said first chamber between said first location and said inlet port of said pump means is not blocked; and in which is included a second gate means for providing a substantially liquid tight gate in said second chamber between said outlet port of said pump means and said second location and for movement between a first position in which liquid flow through said second chamber between said outlet port and said pump means and said second location is blocked and a second position in which liquid flow through said second chamber between said outlet port of said pump means and second second location is not blocked; and in which said liquid passageway means allows liquid to pass from said second chamber to said first chamber when said second gate means is in said first position, said liquid passageway means being closed when said second gate means is in said second position.

5. The hydraulic pumping system of claim 4 in which is included first ballast means for urging said first gate means to said first position, and in which is included second ballast means for urging said second gate means to said first position.

6. The hydraulic pumping system of claim 1 in which is included a first gate means for providing a substantially liquid tight gate in said first chamber between said first location and said inlet port of said pump means; and in which is included a second gate means for movement between a first position in which liquid flow through said liquid passageway means is unrestrained and a second position in which liquid flow through said liquid passageway means is blocked.

* * * * *